United States Patent [19]

Uhl

[11] Patent Number: 4,737,623

[45] Date of Patent: Apr. 12, 1988

[54] CANAL STRUCTURE OF AN ELECTRON MULTIPLIER

[75] Inventor: Dieter Uhl, Uttenreuth, Fed. Rep. of Germany

[73] Assignee: Siemens Aktiengesellschaft, Berlin and Munich, Fed. Rep. of Germany

[21] Appl. No.: 865,060

[22] Filed: May 20, 1986

[30] Foreign Application Priority Data

May 28, 1985 [DE] Fed. Rep. of Germany ..... 3519097

[51] Int. Cl.[4] ..... H01J 43/22

[52] U.S. Cl. ..... 250/207; 313/103 CM; 313/105 CM

[58] Field of Search ..... 250/207, 213 R, 213 VT; 313/533-534, 536, 103 R, 103 CM, 105 R, 105 CM

[56] References Cited

U.S. PATENT DOCUMENTS

| | | | |
|---|---|---|---|
| 3,458,745 | 7/1969 | Shoulders | 313/105 CM |
| 3,538,900 | 1/1969 | Rougeot | 250/207 |
| 3,660,668 | 5/1972 | Wolski | 250/213 |
| 3,745,554 | 7/1973 | Grant | 313/105 CM |
| 3,976,905 | 8/1976 | Seidman | 313/105 CM |
| 4,041,343 | 8/1977 | Orthuber | 313/105 |
| 4,150,876 | 4/1979 | Yeuick | 250/213 R |
| 4,422,005 | 12/1983 | Washington | 313/105 CM |
| 4,544,860 | 10/1985 | Guest et al. | 313/105 CM |
| 4,577,133 | 3/1986 | Wilson | 313/103 CM |

FOREIGN PATENT DOCUMENTS

| | | |
|---|---|---|
| 0006267 | 1/1980 | European Pat. Off. . |
| 2602863 | 8/1976 | Fed. Rep. of Germany . |
| 2739711 | 3/1979 | Fed. Rep. of Germany . |
| 2918542 | 11/1979 | Fed. Rep. of Germany . |
| 3150257 | 6/1983 | Fed. Rep. of Germany . |

OTHER PUBLICATIONS

2037 Elektronik, Jrg. 27, No. 8, Aug. 1978, p. 39, IEEE Trans. Nucl. Sci., vol. NS-25, No. 2, 1978, pp. 964-973.
Zeitschrift fuer Physiuk, vol. 110, 1938, No. 9/10. pp. 553-572.
ACTA ELECTRONICA, vol. 14, No. 2, 1971, pp. 41-77 and 201-224.
Philips Technische Rundschau, vol. 30, 1969/70, No. 8/9/10, pp. 259-263.
Physik in unserer Zeit, vol. 12, 1981, No. 3, pp. 90-95.

*Primary Examiner*—Edward P. Westin
*Assistant Examiner*—Khaled Shami
*Attorney, Agent, or Firm*—Kenyon & Kenyon

[57] ABSTRACT

A canal structure of an electron multiplier, especially for an X-ray image intensifier, comprises several perforated metal dynodes which emit secondary electrodes and between each of which a plate-shaped separating element of electrically insulating material with an at least largely regular hole pattern is arranged. This canal structure has a relatively simple design, in which undesirable charging up at the separating elements is prevented to a large degree. The metal dynodes are realized as impingement dynodes of thin perforated foils or screens or nets or grids, where at least four holes each fall on the area occupied by a canal-like hole of the plate-shaped separating element. The plate-shaped separating elements have a comparatively greater thickness than the thickness of the perforated foils or screens and have on their upper and lower flat sides a layer of electrically highly conductive material and have at their hole walls a layer of an electric resistance material.

12 Claims, 1 Drawing Sheet

CANAL STRUCTURE OF AN ELECTRON MULTIPLIER

BACKGROUND OF THE INVENTION

The present invention relates to a canal structure of an electron multiplier, especially for an X-ray image intensifier (amplifiers), having several perforated metal dynodes which emit secondary electrons and between which plate-shaped separating elements of electrically insulating material with an at least largely regular hole pattern are arranged. Such a canal structure is known from DE-OS No. 26 02 863.

Especially for the construction of flat X-ray tube amplifiers, electron multipliers can be used which have a canal structure (see, for instance, "IEEE Transactions on Nuclear Science", vol. NS-25, no. 2, 1978, pages 964 to 973). Similar known structures comprise generally a layer-like design of several perforated metal dynodes which are parallel to each other and between which a plate-shaped separating element of an electrically insulating material with an at least largely regular hole pattern is arranged. The number, diameter and position of the holes in these separator elements are chosen so that, together with corresponding openings in the dynodes, discrete canal-like feedthroughs through the structure are formed. Accordingly, in the canal structure found in the DE-OS mentioned above, the openings of the metal dynodes are nearly concentric with the openings in the adjoining separating layers. While in this known structure, the separator layers fulfill only an insulation function between adjacent dynodes and can therefore be made relatively thin, the dynodes are comparatively thicker since their canal-like openings have curved, for instance, spherical, walls (see the above-mentioned DE-OS) or conical or truncated pyramid-like shape (see for instance. European patent application No. 0 006 267 Al) in order to increase on them the probability of impinging of electrons. Since the dynodes consist of metals with high secondary electron emission or contain surfaces of these metals, a corresponding multiplication of the electrons at each dynode is obtained.

The manufacture of dynodes with appropriately shaped walls is relatively elaborate, however. In addition, there may be the danger of electric charges at the separating elements. Such charges, however, can adversely affect the electron multiplication in the respective canals in such a manner that a uniform multiplication over the entire cross section of the canal structure can no longer be assured directly.

SUMMARY OF THE INVENTION

It is therefore an object of the present invention to improve the canal structure of the type mentioned above such that a relatively simple design becomes possible and the danger of undesirable charges at the insulated separating elements is at least largely prevented.

The above and other objects of the present invention are achieved by the provision that the metal dynodes are formed as impact of baffle dynodes of thin perforated foil or screen or of nets or grids, of which the number of holes is chosen so that always at least four holes fall on the area occupied by a canal-like hole of the plate-shaped separating element, and the plate-shaped separating elements have a relatively larger thickness than that of the perforated foils or screens or of the nets or grids with an electrically highly conductive material on their upper and lower flat sides, and have at least at their perforated walls, a layer of an electric-resistance material.

With the canal structure according to the invention, the secondary electrons are released at the specially shaped walls, not as in the known embodiments, but by means of impact dynodes known per se (see, for instance, "Zeitschrift fuer Physik", vol. 110, 1938, no. 9/10, pages 553 to 572) of electrons which impinge in the vicinity of the openings of the respective canals in the plate-shaped separating elements and impinge there on the straps between the holes of the perforated coils or screens. Thereby, defined potential conditions between the individual metal dynodes are assured and charging at the separating elements is prevented (see, for instant, "Acta Electronica", vol. 14 no. 1, 1971, pages 41 to 77 and 201 to 224). Since commercially available parts can be used for the dynodes as well as the separating elements, the design of the canal structure according to the invention is accordingly simple.

BRIEF DESCRIPTION OF THE DRAWING

The invention will be explained in greater detail in the following detailed description with reference to the drawing FIGS. 1*a* and 1*b* which shows the basic design of a canal structure according to the invention.

DETAILED DESCRIPTION

Figure 1A:
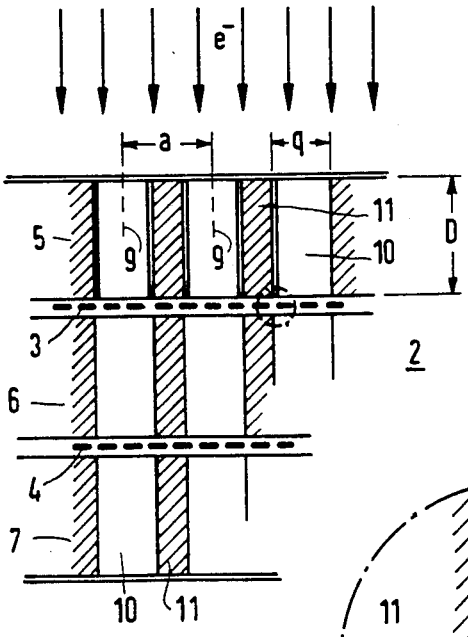
Figure 1B:
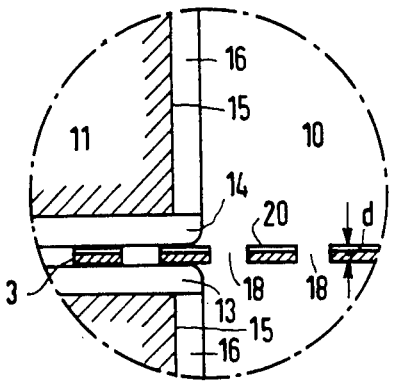

With reference now to the drawings, the canal structure which is shown in the figures in a cross section and is generally designated with 2 serves for electron multiplication, especially in an X-ray image amplifier known per se. The dotted circle in FIG. 1*a* is shown magnified in FIG. 1*b*. It should be possible to achieve multiplication as uniform as possible, of about 500 and a resolution of at least 2 line pairs per mm should be assured. In the canal structure 2 according to the invention, the electron multiplication takes place at coated perforated metal foils 3, 4 or corresponding metal screens or nets or grids which are placed as impact dynodes between perforated glass or ceramic plates 5 to 7. Perforated glass plates and perforated metal foils are stacked up alternatingly. According to the embodiment shown, three perforated glass plates 5 to 7 are assumed (see, for instance, "Philips Technische Rundschau", vol. 30, 1969/70, no. 8/9/10, pages 259 to 263 or German patent No. 27 39 711), between which two perforated metal foils 3 and 4 are arranged and fastened without spacing. Depending on the desired multiplication, however, an appropriate construction with a larger number of perforated glass plates and perforated metal foils can be provided. The perforated glass plates are identical with each other so that, with adjusted stacking, their holes determine through-canals. A d-c voltage is then applied to the perforated glass plates, whereby field intensities up to, for instance, one kV/mm are generated in the holes. The voltage at the respectively following perforated glass plates can be chosen, for instance, 10% higher than the voltage of the perforated glass plates connected in series therewith.

For instance, the perforated glass plates 5 to 7 consist of a photo-etchable glass such as is known under the trade name "FOTURAN" (firm "Schott Glasswerke", D-6500 Mainz). The axes 9 of their cylindrically etched holes 10 always have a spacing a of about 0.25 mm or less from each other and can be distributed in such a manner that their connecting lines form equilateral triangles among themselves. Other arrangements of the hole distribution are equally well possible. The diameters q of the canal-like holes 10 are etched as large as possible. It must be assured however, that no breakthroughs in the cross pieces 11 formed between adjacent holes are generated and, in addition, the mechanical strength of the glass plate is sufficiently high. The thickness D of the plates should be no more than 2 mm and preferably at most 1 mm. On the upper and lower side of each perforated glass plate, a layer 13 or 14 of electrically highly conductive material such as Cr-Au is applied which serves for supplying potential.

Before the perforated glass plates 5 to 7 are provided with the respective layers 13 and 15, thin layers 16 of an electric resistance material must be applied or formed there on the hole walls 15 of the canal-like holes 10 in the manner known per se (see, for instance, DE-OS No. 29 18 542). Such layers in the canal-like holes with layer thicknesses of generally at least 50 nm are known per se (see, for instance, the metnioned literature reference from "Acta Electronica" 14). As the resistance material, lead is suited, for instance, if a glass material of the perforated glass plates 5 to 7 containing lead-oxide is taken as the starting point, layers of this metal can then be made, for instance, by subjecting this glass material on the walls 15 to a reduction treatment so that metallic lead is then obtained there. Also the deposition of lead oxide on the walls of the canal and subsequent reduction are known (see, for instance, "Physik in unserer Zeit", vol. 12, 1981, no. 3, pages 90 to 95).

In the manufacturing process of the layer 16, also the two flat sides of each perforated glass plate are generally provided with appropriate coatings. These coatings can optionally, as assumed in accordance with the embodiment example shown, be removed again before the layers 13 and 14 are deposited, or they can be left there. With these resistance layers 16, a uniform potential transition between the layers 13 and 14 is, for one, assured; secondly, undesired charging-up effects at the walls of the hole can be prevented thereby.

The perforated plates 5 to 7 have mainly the following functions in the electron multiplier:

(1) The active area of the multiplier is subdivided into small delineated subareas. Each of the subareas results in a picture dot and can be considered by itself as an individual multiplier. The walls of the holes ensure that electrons once they have entered cannot get into an adjoining hole.

(2) Mechanically, the perforated plates 5 to 7 serve as carriers for the perforated metal foils 3 and 4 which are thinner by several orders of magnitude. They can therefore also be called plate-shaped carrier elements.

The perforated metal foils 3 and 4 or the metal screens nets or grids are made, for instance, by electroplating and generally have a thickness d of less than 10 $\mu$m, for instance, between 2 and 6 $\mu$m. Their mesh or hole number is chosen large enough so that at least four, but preferably at least five holes or meshes fall on the cross-sectional area of a hole 10 of the perforated glass plates 5 to 7. The transparency of each metal hole foil, i.e., the portion of the surface of the total area of the perforated foil occupied by its holes 18 is chosen to be between approximately 20 and 80%. On each surface of the perforated metal foils is applied a layer 20 which has high secondary electron emission. Optionally, the perforated metal foils may also consist completely of such a material.

Since the metallic parts of the perforated metal foils 3 and 4 also cover part of the cross-sectional areas of the canal-like holes 10 in the perforated glass plates 5 to 7, part of the electrons $e^-$ striking the canal structure 2 impinges there and thus releases secondary electrons in the manner known per se. Perforated metal foils acting in this manner are therefore also called impingement dynodes (see the cited literature reference from "Zeitschrift fuer Physik").

For preparing a thin layer 20 with a large secondary electron emission factor on the metallic surface of a perforated metal foil (for instance, a perforated Ni-sheet or Ni-screen), the latter is cleaned and etched and then baked out in a vacuum (for instance, at 700° C. for 30 minutes at $1\times10^{-5}$ Torr). After oxidation at a small oxygen pressure (for instance, at 700° C. for 5 minutes, $1\times10^{-3}$ Torr $O_2$), the surface is then vapor-deposited at room temperature with an alkali halogenide (for instance, CsJ) or earth alkali halogenide (for instance, $BaCl_2$). The baking out in the vacuum can also be performed with simultaneous evaporation of an alkali halogenide or earth alkali halogenide (for instance, 550° C., 85 min., $1\times10^{-5}$ Torr with simultaneous evaporation of CsI or 850°, 90 min., $1\times10^{-5}$ Torr with simultaneous evaporation of $BaCl_2$). If the thickness of these vapor-deposited layers 20 are chosen sufficiently small, for instance, between 1 and 20 nm, and preferably less than 10 nm, no troublesome charging of the layers takes place. It is therefore possible to operate the layers with continuous current without a drop in the secondary emission coefficient.

Besides and CsJ and KBr as the secondary electron-emitting layer material, for instance, NaCl, KJ or LiCl can be chosen as the layer materials. These materials can be deposited, besides on the assumed Ni material, also directly on other materials of the perforated metal foils such as Al, Ti or CrNi steel.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. Canal structure of an electron multiplier, especially for an X-ray image amplifier, having a plurality of perforated metal dynodes for emitting secondary electrons, between each of which a plate-shaped separating element of electrically insulating material with a substantially regular hole pattern comprising a plurality of canal-like holes is arranged, the metal dynodes comprising impingement dynodes of thin perforated foil means, the number of holes of said foil means being such that always at least four holes are disposed in the area occupied by a canal-like hole of the plate-shaped separating element, the plate-shaped separating elements having a comparatively greater thickness than the thickness of the perforated foil means and being provided on upper and lower flat sides thereof adjacent said foil means with a layer of an electrically highly conductive material and having, at least along walls of said canal-like holes, a layer of an electric resistance material.

2. The canal structure recited in claim 1, wherein the thickness of the metal dynodes in less than 10 $\mu$m.

3. The canal structure recited in claim 2, wherein the metal dynodes have a thickness between 2 and 6 μm.

4. The canal structure recited in claim 1 wherein the number of holes of the metal dynodes is at least 5 holes for each canal-like hole of the plate-shaped separating elements.

5. The canal structure recited in claim 1, wherein the transparency of the metal dynodes is between 20 and 80%.

6. The canal structure recited in claim 1 wherein the plate-shaped separating elements comprise perforated glass or ceramic plates.

7. The canal structure recited in claim 1, wherein the thickness of the plate-shaped separating elements is at most 2 mm and preferably at most 1 mm.

8. The canal structure recited in claim 1, wherein a secondary electron emitting layer having a thickness of less than 50 nm is applied to a surface of the metal dynodes.

9. The canal structure recited in claim 8, wherein said layer emitting secondary electrons is less than 30 nm in thickness.

10. The canal structure recited in claim 8 wherein the layer emitting secondary electrons comprises an alkali halogenide or earth alkali halogenide.

11. The canal structure recited in claim 1 wherein the layer of the resistance material is at least 50 nm thick.

12. The canal structure recited in claim 1 wherein the thin perforated foil means are thin screen means or thin net means or thin grid means.

* * * * *